US005385683A

United States Patent [19]

Ransom

[11] Patent Number: 5,385,683

[45] Date of Patent: Jan. 31, 1995

[54] ANTI-FRICTION COMPOSITION

[76] Inventor: Louis J. Ransom, P.O. Box 515, Branchville, N.J. 07826

[21] Appl. No.: 131,738

[22] Filed: Oct. 5, 1993

[51] Int. Cl.[6] ..... C10M 139/00; C10M 141/12

[52] U.S. Cl. ..... 252/35; 252/37

[58] Field of Search ..... 252/12, 12.2, 35, 37

[56] References Cited

U.S. PATENT DOCUMENTS

| | | | |
|---|---|---|---|
| 2,214,104 | 9/1940 | Hildabolt et al. . | |
| 2,450,633 | 10/1948 | Clayton . | |
| 2,504,672 | 4/1950 | Farrington et al. . | |
| 2,956,848 | 10/1960 | St. Clair . | |
| 3,028,334 | 4/1962 | Wilson | 252/35 |
| 3,155,617 | 11/1964 | Voorhees . | |
| 3,262,889 | 7/1966 | Edwards et al. | 252/35 |
| 3,412,026 | 11/1968 | Booher . | |
| 3,459,605 | 8/1969 | Jolly | 252/35 |
| 3,462,367 | 8/1969 | Booher . | |
| 3,467,596 | 9/1969 | Hermann . | |
| 3,488,722 | 1/1970 | Allphin, Jr. . | |
| 3,516,933 | 6/1970 | Andrews et al. . | |
| 3,630,897 | 12/1971 | Rohde et al. . | |
| 3,772,197 | 11/1973 | Milsom . | |
| 3,839,209 | 10/1974 | Hermann et al. . | |
| 3,933,656 | 1/1976 | Reick . | |
| 4,029,682 | 6/1977 | Foulks, Jr. | 252/35 |
| 4,284,518 | 8/1981 | Reick . | |
| 4,284,519 | 8/1981 | Reick . | |
| 4,915,856 | 4/1990 | Jamison . | |
| 5,021,598 | 6/1991 | Patnaik et al. . | |
| 5,266,225 | 11/1993 | Hall et al. | 252/35 |

OTHER PUBLICATIONS

"Bismuth and Bismuth Alloys", believed to be *ECT*, vol. 3, pp. 912–921, S. C. Carapella, Jr., & H. E. Howe, ASARCO Inc. date unknown.

Webster's Third New International Dictionary of the English Language Unabridged, G. & C. Merriam Company, Springfield, Mass., 1976, p. 1343.

McGraw-Hill Dictionary of Scientific and Technical Terms, Third Edition, McGraw-Hill Book Company, U.S.A., 1984, p. 944.

The Random House Dictionary of the English Language, Second Edition, Unabridged, 1983, U.S.A., 1987, p. 1142.

*Primary Examiner*—Jacqueline V. Howard

*Attorney, Agent, or Firm*—Staas & Halsey

[57] ABSTRACT

An anti-friction composition creating a protective coating between two moving metal parts under high pressure and the resultant high temperatures, for example, the valve train of an internal combustion engine. The composition includes basically a liquid mixture of organometallic compounds, such as a bismuth/organic carrier liquid component and a tin/organic carrier liquid component. The liquid organometallic compounds hold the bismuth and tin metals until they atomically dissociate under high pressure and/or temperature conditions, releasing the bismuth and tin metal atoms and/or molecules. These raised atoms and/or molecules form an alloy that protectively coats the machinery metal surfaces, greatly reducing friction and wear.

44 Claims, 9 Drawing Sheets

ANTI-FRICTION COMPOSITION

BACKGROUND OF THE INVENTION

1. Field of the Invention

This invention relates to an anti-friction composition and, more particularly, to a lubricant additive that provides a protective coating to moving metal parts and reduces friction and wear therebetween.

2. Related Art

Friction occurs when two surfaces in relative motion, such as metal machinery component surfaces, contact each other. This friction results in the gradual removal of solid material from the contacting surfaces, i.e., wear. By reducing the friction, wear can be reduced.

More particularly, metals have surface asperities that strike each other when pressed close enough together, especially under extreme pressure, resulting in the "welding" and tearing of the metal surfaces. This wear is known as adhesive wear, scuffing, contact wear, galling or boundary lubrication wear. Many attempts have been made to reduce this wear.

In this regard, it is widely known that lubrication has a profound effect in reducing wear. Lubrication separates the moving surfaces with a film which can be sheared with low resistance, without causing damage to the surfaces. Examples of conventional lubricants follow.

First, a softer metal can be used to coat a harder metallic surface sought to be protected. For example, the introduction of the soft metal lead into a machinery lubricant such as oil has effectively been used for this purpose.

Lead, however, has been shown to combine with sulfur which is often present in the lubricant, and can result in corrosives being formed which then attack the actual metals for which protection is sought. Additionally, lead is extremely toxic and should be avoided.

Second, certain shearable protective substances which adhere physically to the surfaces to be protected, have been used for wear reduction. Under high pressure, part of the protective substance is sheared off and redeposited forward of the sheared section. Molybdenum disulfide is such a substance.

Molybdenum disulfide, however, is not as effective as lead, and cannot endure the same pressures and afford the same protection as lead. This chemical also still results in the base metals' asperities striking each other, so wear will still occur.

Graphite is also such a substance, since it depends upon the shearing action of the graphite crystal. Graphite, however, is even less effective than molybdenum disulfide.

Both graphite and molybdenum disulfide, solid substances, have the further disadvantage that, if used in a very high pressure, slow speed application, they can "pack" a bearing so tightly that seizure of the bearing may occur with much subsequent damage.

Third, a protective coating of polytetrafluoroethylene ("PTFE"), a plastic-like substance sold commercially by DuPont as Teflon TM, has been used as an oil additive. An example of such a popular commercial product is believed to be Slick 50 TM. PTFE migrates to the interstices of metal surfaces, providing a physical bond with the machinery metals and a protective layer.

While it is known that wear and friction can be reduced by the introduction of PTFE in liquid lubricants, (see, e.g. U.S. Pat. No. 3,933,656) PTFE is a soft resin that cannot endure very extreme pressures of two metals being pressed together.

Fourth, there also is known the introduction into a lubricant of chemical additives which "contaminate" the metal surface. These additives are intended to prevent or reduce the welding that occurs when the surface asperities come into contact. Sulfur, phosphorus, and chlorine compounds have been used for this purpose.

These compounds, or combinations thereof, perform by chemically reacting with the iron surface of the metal parts to form the respective contaminating compounds, iron chloride, iron phosphide, iron phosphate, iron sulfide, and iron sulfate. It is believed the commercially popular oil additive product Duralube TM is a "contaminant" additive, since it appears to be a butyric acid chloride in naphtha, specifically Shell TM Sol #140.

Another example of a contaminant additive is Zinc Dialkyl-dithiophosphate ("ZDDP"), which is used as an extreme pressure antiwear additive in gear lubes, wheel bearing greases, etc. ZDDP is available from Elco Corporation in Cleveland, Ohio, and Lubrizol. The sulfur and phosphorus thereof combine with the iron to form a contaminant layer of iron sulfide or sulfate, iron phosphide or phosphate and reduce the welding of the iron on the two rubbing metal surfaces.

The disadvantages with using contaminant chemical additives follow.

In combining with the machinery metal, it is necessary to use or "eat up" part of the metal itself in order to create the protective layer, a self-defeating process. Thus, the above chemicals can only slow wear, not stop it.

Additionally, because of the chemical nature of these protective substances, excessive use can be harmful as corrosive effects can occur.

If a combination of the third and fourth approaches described above is attempted, i.e., PTFE added to these chemically reactive, contaminant-type additives, for added anti-friction properties, the PTFE tends to migrate to the interstices of the machinery metal before the chemical reactions take place. This PTFE coating, which is relatively unreactive, then tends to interfere with the reaction of the contaminant type additives in that they are prevented from reaching the machinery metal surfaces. With enough pressure the PTFE layer is broken through and adhesive wear occurs. The wear can be reduced only when the contaminant type additive is allowed to react with the machinery metal surface and form the contaminant protective layer.

Fifth, it is known to use a mixture of bismuth metal and tin metal to provide wear and friction reduction. U.S. Pat. No. 4,915,856 describes that these metals, as well as others from the group lead, copper, zinc, antimony, aluminum, magnesium, selenium, arsenic, cadmium, tellurium, graphite, and indium, can be mixed in powdered form with an epoxy or polymeric organic carrier and a percentage of oil or grease for lubricating rail car wheels and other external applications of similar nature.

This patent, however, describes that direct application of the modified lubricant to the machinery metal surface is required, which is not practical in many applications, such as liquid petroleum lubricants for gasoline and diesel engines. Prior coating of engine parts before assembly is also not practical as it is labor intensive, time consuming, and the polymeric carrier would be diluted by the usual lubricant of the engine, resulting in the powder/polymeric mixture coating being quickly worn off during operation of the engine and washed away by the action of detergent additive packages usually incorporated in the petroleum lubricants used. Further, the dry lubricant introduced in the form of a powder would be quickly removed by a lubricant filter which is usually present in the machinery. Settlement and the clogging of oil passages is also a problem.

Although the prior art lubrications described above provide some anti-friction benefits, the health, environmental, corrosion, and efficiency drawbacks associated therewith are significant. The prior art, therefor, does not teach an effective, non-corrosive, non-toxic, non-metal reacting anti-friction composition.

SUMMARY OF THE INVENTION

Accordingly, it is a purpose of the present invention to provide an anti-friction composition that does not chemically react, but only physically cooperates, with moving metal parts.

It is another purpose of the present invention to provide an anti-friction composition that is non-toxic.

It is another purpose of the present invention to provide an anti-friction composition that is more environmentally friendly than conventional compositions.

It is another purpose of the present invention to provide an anti-friction composition that creates a protective coating between two moving metal parts, to reduce friction and wear of the metal parts.

It is another purpose of the present invention to provide an improved anti-friction composition that can be used with metal parts moving under high pressure, such as bearings, electric motor shafts, automatic transmissions, and gear boxes.

It is another purpose of the present invention to provide an anti-friction composition, including a bismuth-/organic carrier liquid component and a tin organic carrier liquid component, which, under high pressure and resultant high temperature, dissociates to form a bismuth/tin alloy that protectively coats the moving metal parts.

It is another purpose of the present invention to provide an anti-friction composition that, under high pressure and resultant temperature, forms a low-friction coating on moving metal parts of machinery, and further includes PTFE for increased friction resistance in areas of the machinery operating under relatively lower pressure and temperature.

It is another purpose of the present invention to provide an engine oil additive that is capable of dissociating out a protective metal coating, and the remainder of the composition is non-harmful to the engine parts and the environment.

Finally, it is a purpose of the present invention to provide an engine oil additive that, under high pressure and temperature conditions, causes free bismuth and tin molecules to dissociate from organic carriers in the additive, and form an alloy that coats moving metal parts, thereby reducing friction and wear therebetween.

To achieve these and other purposes of the present invention, there is provided an anti-friction composition which creates a protective coating between two moving metal parts under high pressure and the resultant high temperatures. The composition includes basically a liquid mixture of organometallic compounds and, more particularly, a bismuth/organic carrier liquid component and a tin/organic carrier liquid component. The respective organic carriers hold the bismuth and tin until they experience a high pressure environment. In the high pressure environment, temperatures rise to the point where the liquid organometallic compounds atomically dissociate, releasing free bismuth and tin atoms and/or molecules. These atoms and/or molecules form a metal alloy that physically cooperates with the moving metal surfaces to form a protective coat which greatly reduces friction and wear.

As an optional ingredient, PTFE can be added to provide anti-friction properties at those areas of the machinery that operate at relatively lower pressure and temperature.

With this invention, the metal parts do not react chemically with the bismuth/tin alloy or any of the rest of the composition. The relationship is merely physical with the alloy tenaciously covering and protecting the metal parts of the engine from friction. In this way the surface of the metal is not "eaten up" or otherwise changed.

Also, since the wear of metal parts in the engine is reduced, the damaging presence of metal particles in the engine oil is reduced.

Further, the components of the composition are relatively safe, environmentally friendly and non-toxic, when compared with the prior art lubricant additives discussed above.

Finally, because better friction protection is provided, the composition is believed to reduce oil and fuel consumption.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate characteristics of the invention and, together with the description, serve to explain the principles of the invention.

DESCRIPTION OF THE PREFERRED EMBODIMENTS

Figure 1:
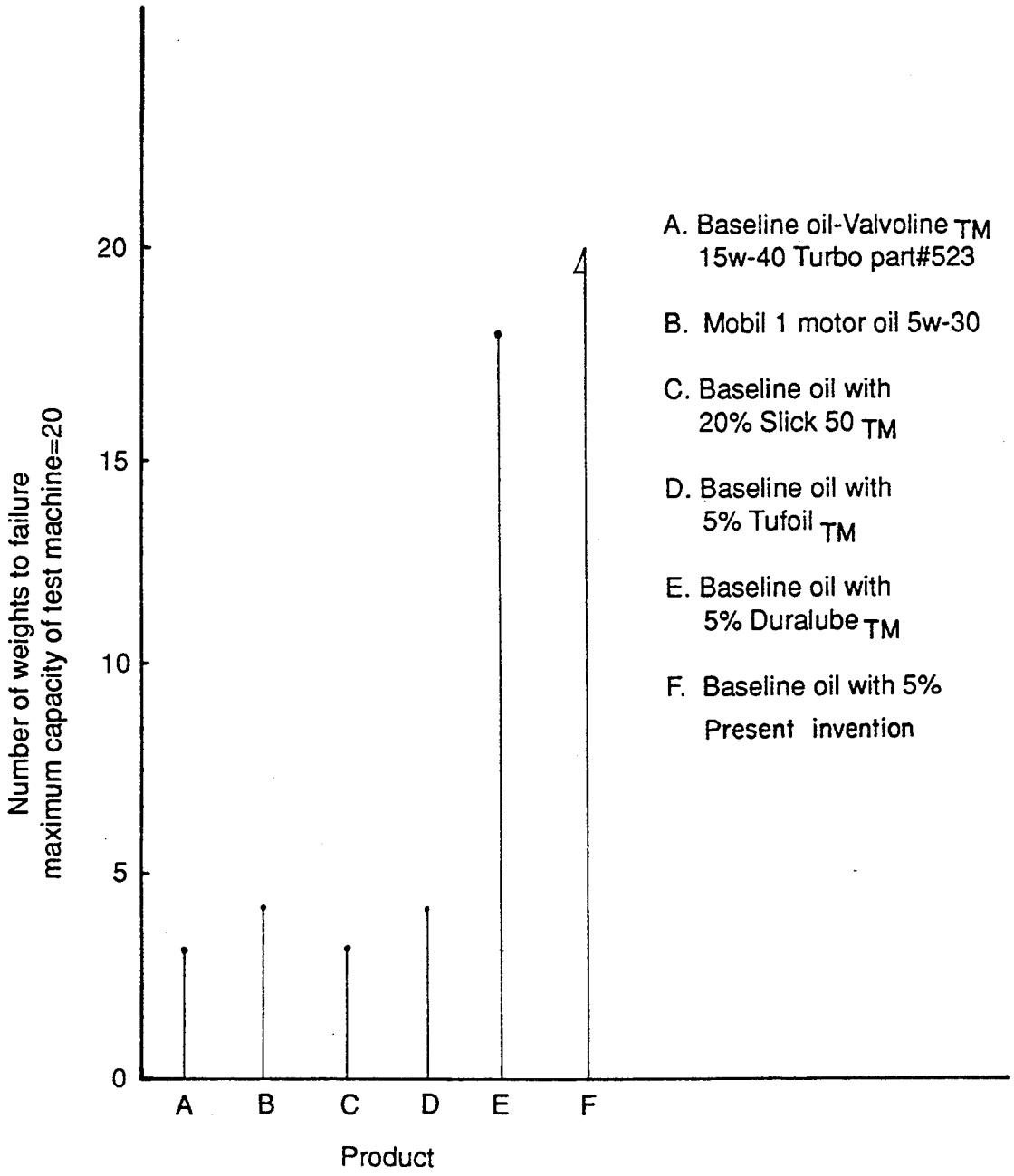
FIG. 1 is a graph of the points of failure of certain lubricants tested with a Timken Bearing Test machine.
Figure 2:
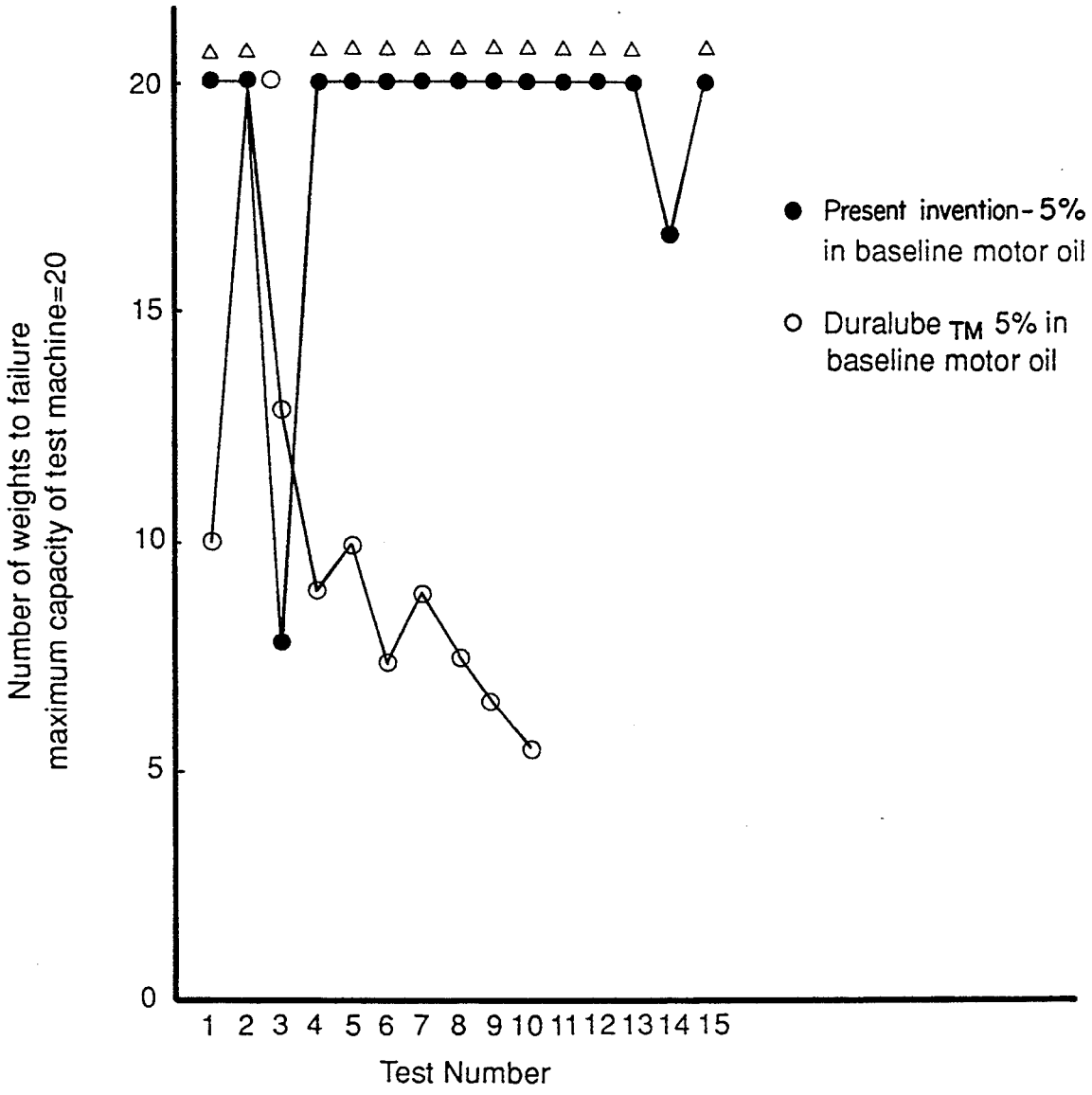
FIG. 2 is a chart comparing the number of weights to the point of failure for consecutive tests on an acid chloride product and the subject invention.
Figure 3:
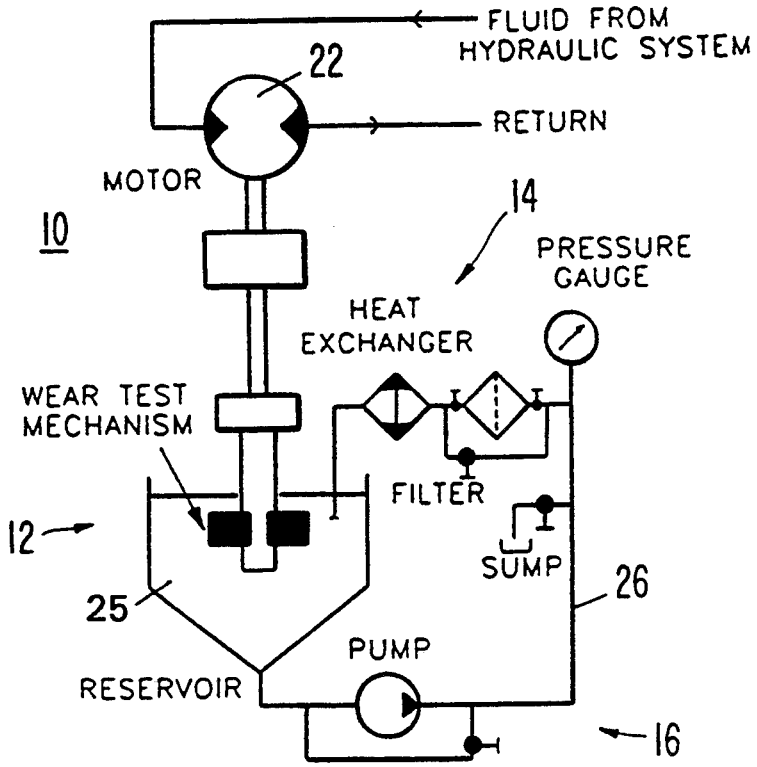
FIG. 3 is a schematic diagram of the components of a Gamma Test System.
Figure 4:
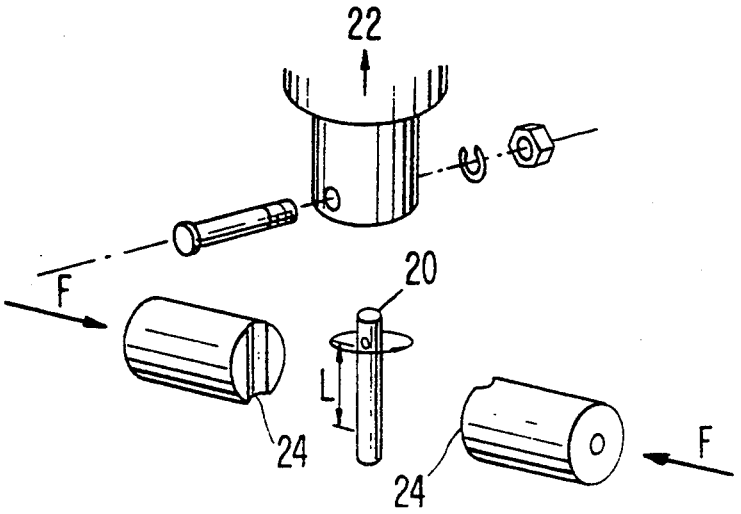
FIG. 4 is an exploded view of the journal and bearing arrangement for the Gamma Test System shown in FIG. 3.
Figure 5:
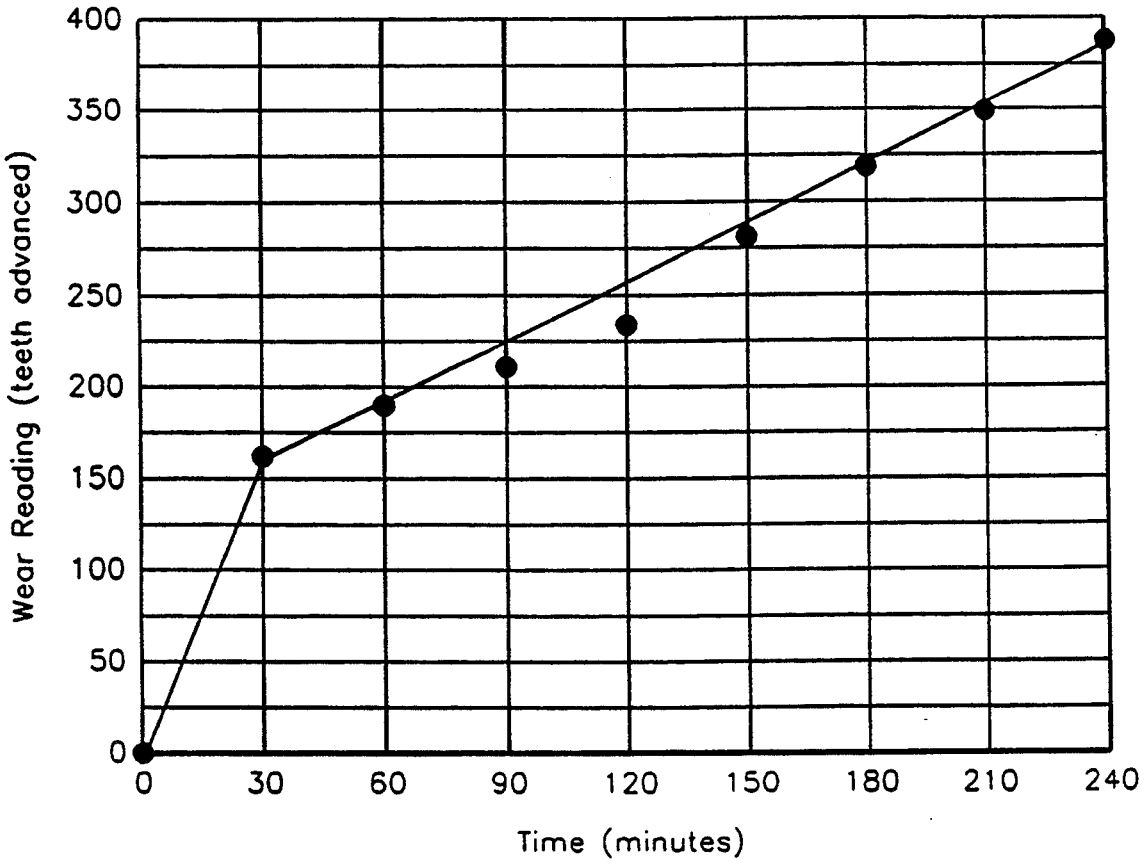
FIG. 5 is a graph illustrating a load resistance test on the Gamma System using Valvoline TM 15W40 only.

The present invention is directed to a composition for forming a protective coating which reduces friction and wear for moving metal parts in a high pressure area of machinery, for example, the valve train of an internal combustion engine. Other applications include anywhere metals move relative to each other under high pressure, e.g., bearings, electric motor shafts, automatic transmissions, gear boxes, etc.

The composition includes a mixture of organometallics in the form of a metal/organic carrier liquid component, and another metal/organic carrier liquid component. The respective organic-carriers must be atomically combined with the metal only until put into a high pressure environment, at which time the high temperature caused by the pressure causes the components to dissociate, yielding free metal molecules which form an alloy that physically protectively coats the moving metal parts.

Although it is possible to use a single liquid organic carrier that atomically combines with both bismuth and tin, and dissociates each under high pressure, such a single organic carrier is not presently known by the inventor. Nevertheless, such a single organic carrier is contemplated by the present invention.

The organometallic compounds should be selected according to the following criteria as well as the pressure, temperature, and other pertinent conditions dictated by the particular application:

1. The dissociated metals should form an elemental or alloy coating to endure the most extreme pressure and temperature expected to be encountered in the application.

2. The organometallics should remain in liquid form and be able to maintain stability in a liquid petroleum lubricant until needed at the machinery metal surfaces.

3. Once the anti-friction protection is needed at the machinery metal surfaces, the organometallics must quickly dissociate at the desired pressure and temperature, releasing the protective metals which form the coating.

4. The metals which form the coating should quickly embed themselves in the interstices of the machinery metal surface forming a physical bond.

5. The coating should not chemically react with the machinery metal surface. This non-reactivity allows a true protective coating to be formed on top of the machinery metal surfaces and not a contaminant layer as with chlorine, sulfur, or phosphorous which form a layer that is subsurface of the original machinery metal surface.

6. The non-metal portions of the organometallic molecules should be as non-corrosive as possible so as not to be damaging or injurious of the machinery metals themselves.

7. The metals forming the metal/alloy coating should be as environmentally friendly and as non-hazardous as possible.

8. The non-metal portions of the organometallic molecules should be as environmentally friendly and as non-hazardous as possible.

9. Both the metals released and the non-metal portions of the organometallic molecules should not chemically react with other additives in the lubricant, or form corrosives or other harmful compounds which may be injurious to the machinery itself or otherwise reduce its service life.

10. If used in an engine, the organometallics, or atomic or molecular parts thereof, should not cause harmful effects to the engine itself or, upon being exhausted, to the subsequent components of the exhaust system, and shall not be environmentally hazardous when released to the atmosphere.

11. If used in an engine, the organometallics, and no part thereof, should, upon entering the combustion chamber, be oxidized or form other compounds or byproducts, which would be harmful to the engine itself, or, upon being exhausted, would be harmful to the subsequent components of the exhaust system, and/or be hazardous to the environment.

12. If it is desirous to include PTFE in the formulation to increase the capability of wear and friction reduction, as discussed below, the organometallics should be compatible with the PTFE and the subsequent coatings formed on the machinery metal surfaces.

The preferred metals of the organometallics of the present invention are bismuth and tin, each atomically combined with an appropriate organic carrier. This arrangement is contrary to the prior art's physical dispersion of a bismuth or tin metal powder and an organic polymeric, epoxy, solvent, or petroleum vehicle, discussed above. These conventional powders are not organic, or liquid, and would not provide protection in an engine lubricant since they are already in an oxidized state. The energy needed to dissociate the bismuth and tin from such powders is too high for almost all applications. Additionally, being in powdered form, the powdered metals are prone to settlement and are not easy to maintain as a dispersion in a lubricant. The powder is also abrasive and could contribute to wear rather than reduce it.

Bismuth and tin alloys are known for their friction and wear reducing properties and the relative non-toxicity of the subject metals. Further, a bismuth-tin alloy expands upon cooling which, it is believed, helps to physically lock the protective alloy coating into the machinery metal surface interstices and prevent their removal from both boundary lubrication and the turbulence of hydrodynamic lubrication.

In light of the above teaching concerning the characteristics of the organometallics of the invention and the metals in particular, examples of the preferred embodiments of the organometallics follow.

Chemical Name: Bismuth 2-Ethylhexanoate
- Supplier: Shepherd Chemical Company, Cincinnati, Ohio
- Trade names: 28% bismuth octoate HFN (High Flash Naptha) 28% bismuth octoate MSF (Mineral Spirits Free)
- Supplier: O.M. Group, Cleveland, Ohio
- Trade name: 28% Bismuth hex-cem Chemical Name: Dibutyltin Dilaurate
- Suppliers: Shepherd Chemical; O.M. Group; Witco Corporation, Perth Amboy, N.J.
- Trade name: None; sold under the chemical name.

In addition to the above organometallics, the following organometallics can be used. These are liquid metal-containing organics with the metal atom (or atoms, as there may be more than one tin or one bismuth per molecule) as part of the organic molecule. Dissociation at a certain temperature also applies to these organics.

Chemical Name: Bismuth Neodecanoate (20% Bismuth Content)
Supplier: Shepherd Chemical
Trade name: None
Supplier: Mooney Chemical (O.M. Group)
Trade name: Bismuth Ten-Cem
Chemical Name: Dibutyltin Dineodecanoate (20% Tin Content)
Supplier: Mooney Chemical
Trade name: none
Chemical Name: Dibutyltin Diacetate
Supplier: not known
Trade name: not known When using the bismuth neodecanoate and dibutyltin dineodecanoate, the percent by weight would be different than for the bismuth 2-ethylhexanoate and dibutyltin dilaurate combination. The preferred ratio has been found to be approximately 11 parts by volume of bismuth neodecanoate to 1 part of dibutyltin dineodecanoate. While this combination may be slightly better in performance than bismuth 2-ethylhexanoate with dibutyltin dilaurate, the bismuth neodecanoate has a strong odor which could be objectionable for a consumer additive. Any of these compounds, however, can be varied over a wide range to suit specific needs.

These organometallics are preferred for the temperatures at which they dissociate and for their relative non-toxicity, safety for machinery, and safety for the environment. However, any organic chemical which fits the above criteria can be used. The organics can also be tailored to fit a specific use, but the mechanism of dissociation to form the bismuth-tin alloy coating would be the same in all cases.

The organic chemical is a liquid vehicle by which the solid metallic elements can be made liquid and introduced into lubricants in an easy and convenient fashion. As a liquid, the bismuth and tin can mix with the lubricant and wait, in liquid form, until they are needed at the points of wear and metal to metal contact.

There are both low and high pressure areas between the various parts of various machines. An example of a low pressure area in an internal combustion engine would be between each piston and the cylinder walls, which is in contrast to the high pressure areas such as the valve train system of the engine.

In the low pressure areas of a machine, boundary lubrication may not occur, the bismuth-tin alloy may not form, and PTFE can be added to the composition to provide a substantial, added benefit in these areas of hydrodynamic lubrication. PTFE is characterized in greater detail below.

Chemical Name: Poly-Tetrafluorethylene
Supplier: Dupont
Trade name: Teflon MP1100 note: Teflon MP1100 is chosen for its particle size but any Teflon powder can be used if reduced in size by further processing.
Suppliers: ICI Fluoropolymers, Exton, Pa.; Whitcon TL Fluoropolymer Lubricants, TL 102. Same note regarding particle size applies to this supplier.

The PTFE provides friction reduction (due to is physical properties) beyond that of the bismuth-tin alloy. It remains in effect at low pressure areas because the PTFE film is strong enough to endure the force encountered. As the pressure increases, the PTFE film is broken through to expose the metal surface. It is at this point the bismuth-tin takes over and provides the protection for the higher pressures and temperatures resulting from the contact. Should the higher pressure be relieved, the PTFE can then form a coating on top of the alloy and provide a further reduction in friction.

The action of the PTFE and the action of the bismuth-tin combination complement each other so that all friction areas are covered, i.e., low pressure by the PTFE and high pressure by the bismuth-tin alloy. If a machine is to be protected which has only high pressure areas and no low pressure, the PTFE can be eliminated with no reduction in wear protection.

The PTFE is optional because it is a powder which is a solid, and there may be applications where having a dispersed solid in the lubricant may be undesirable, however soft or however beneficial in reducing friction the PTFE may provide, i.e., regardless of the benefits of PTFE the fact that it is a solid may be detrimental in some applications.

Further details regarding the methods of preparation and use of the composition of the present invention follow:

1. Select an appropriate liquid organometallic of bismuth to suit the application. In the preferred embodiment, bismuth 2-ethylhexanoate is used, which has been diluted with Shell solvent #140 to produce a 28% component by weight of metallic bismuth.

This particular compound has a boiling point of 300° F. and a flash point over 500° F., and will dissociate in a range above the operating temperature of the parent lubricant (in an auto engine, about 300° F.) but lower than the much higher temperatures encountered at the point of metal to metal proximity and/or contact points (up to several thousand degrees F.). The expected range for dissociation in an internal combustion engine is about 325° F. to about 400° F.–500° F. This compound also has the remaining qualities of reaction, solubility in petroleum products, and safety to render it appropriate to the selection criteria stated above.

Any other appropriate liquid bismuth organometallic can be used, however, as those skilled in the art may select.

It is not recommended to use compounds containing thiols, mercaptans, phosphorus, or chlorine as these will contaminate the machinery metal surfaces, interfere with the proper physical bonding of the desired metal or alloy coating, be corrosive, and potentially be environmentally hazardous or form environmentally hazardous compounds.

2. Select an appropriate liquid organometallic of tin to suit the application. In the preferred embodiment dibutyltin dilaurate is used with an 18%–19% component by weight of metallic tin.

This compound has a boiling point of 300° F. and a flash point over 500° F., and will dissociate in a range above the operating temperature of the parent lubricant but lower than the much higher temperatures encountered at the point of metal to metal proximity and/or contact points. Again, the expected range for dissociation in an internal combustion engine is about 325° F. to about 400° F.–500° F. This compound also has remaining qualities of reaction, solubility in petroleum products, and safety to render it appropriate to the selection criteria stated above.

Again, any appropriate liquid tin organometallic can be used as those skilled in the art may select.

It is not recommended to use thiols, mercaptans, phosphorus, or chlorine containing compounds for the same reasons as stated for the selection of the bismuth organometallic.

3. Thoroughly blend 7 parts by volume of bismuth 2-ethylhexanoate with 1 part by volume of dibutyltin dilaurate. These two components are mixed at room temperature to provide a bismuth-tin solution. The composition is a clear light yellow to brown viscous liquid with a pleasant odor.

This produces an approximate 11 to 1 ratio of bismuth metal to tin metal by weight. This ratio is suitable for most general purposes and has been shown to work well in applications for engines, transmissions, differentials, bearings, and so forth.

The ratios of the above mixes can be varied to fit individual or customized and specific applications for maximum desired benefits.

4. PTFE, if desired, can be added at the rate of one pound by weight to one gallon by volume of the mixture in step (3). The particle size of the PTFE should fit the application, for example, less than one micron for engines where larger sizes could be removed by the lubrication filter, and up to 10 microns for geared components where no filter is present. The smaller sized particles of PTFE can also be used in the geared components with no loss of lubrication effect and adds the convenience of having one additive for multiple applications.

Once again, the ratio expressed is for general use and can be varied to suit a particular application to achieve the maximum benefits desired for which this invention is applied.

5. Add appropriate known surfactants and stabilizers, if desired, and homogenize as necessary to stabilize and maintain the PTFE dispersion.

Running the mixture through a homogenizer, Model MP-6, manufactured by APV Gaulin, Inc., Wilmington, Mass., at 8,000 psi will effectively homogenize the dispersion and adequately reduce separation on standing. This has the additional benefit of reducing the average particle size of the PTFE to below 0.75 microns which is desirable in applications containing filters (such as on an automobile engine). Care should be taken so as to not overwork the PTFE and cause agglomeration.

The mixture should contain no other diluents, distillates, carrier oils or solvents.

6. The composition can then be added to a lubricant.

There is no limitation on the type of lubricant used other than compatibility with the additive. Viscosities are not changed; it will work with any weight or cycle of motor oil, any weight of gear oil, transmission fluid, cutting oils, turbine oil, specialty lubes, and so forth. Addition of this composition to oil in concentrated amounts ranging from 1.0% to 10% reduces wear and friction.

The composition can be used with other liquids and substances not technically considered lubricants. For example, since the additive provides lubrication and protection in the presence of antifreeze (usually considered a contaminant in lubricating oils), it may be possible, in a machine subject to water infiltration, to add the additive along with the antifreeze to the lubricant and prevent the infiltrating water from freezing and causing damage to the machine. One such example may be quarry equipment.

7. The lubricant with additive therein can then be added to metal machinery like an internal combustion engine.

No closed vessel is required for the friction reducing effect of the present invention. It is only the heat generated as a result of increased pressure (and resultant increase in friction) that is needed to cause the dissociation. As an example, the Timken Test described below is done in open air with the lubricant not under pressure. The only pressure present is between the two metal surfaces.

It has been found that an initial higher application is necessary to thoroughly coat all the machinery metal surfaces for complete protection. Once these coatings are established, the reduced amount can be used to maintain the coatings and maintain the protection level, the advantage being reduced cost of application of the invention without reducing the level of protection. Severe adverse conditions as described in the following paragraph may require continued higher application rates.

A preferred general application for engines is an initial application of 3.0% and subsequent applications of 1.5% with each change of lubricant and filter. Automatic transmissions are most preferably treated consistently with an application of 1.5%. Standard or stick shift transmissions, gear boxes, differentials, transfer cases, and machinery under high loads whereby the gears, shafts and components contained within are subject to high pressures, the preferred application is 6.0%, or approximately 2 fluid ounces of additive to each fluid quart of lubricant used for the first application and thereafter 3.0% for subsequent applications, or approximately 1 fluid ounce of additive for each quart of lubricant fluid used.

The specific application rates believed to provide the protection needed are suggested as follows:

a. Engine oil—cars and light trucks equipped with gasoline engines—First application, one ounce per quart of crankcase capacity. Subsequent applications, one ounce per two quarts of capacity. The first application at the higher dose insures all parts are thoroughly coated and protects the metal to metal moving areas of the engine. Thereafter, a "maintenance dose" of one ounce per two quarts of capacity is sufficient to provide continuous protection under normal use.

b. Engine oil—Diesel engines, all types and gasoline engines in heavy duty or severe services—Use one ounce per quart of crankcase capacity. The heavier stresses imposed by diesel engines and severe use of gasoline engines (for example, trailer towing, traffic-jam driving resulting in elevated engine temperature, air-cooled engines such as on lawn and garden equipment, and industrial service equipment) should require the approximate treatment rate of 3% or one ounce of product added per quart of lubricant.

c. Gear oils, greases, marine lubricants, hydraulic fluids, etc., should require the 3% treatment rate for adequate protection of the components in which these lubricants are used.

d. Automatic transmissions—Light duty use 1 ounce per two quarts of capacity. Heavy duty or severe service use 1 ounce per quart of capacity.

e. Extremely severe service—all applications—racing, heavy industrial equipment, drilling, cutting, boring operations, and the presence of severe or repeated contamination of the lubricant requires up to 6% of the treatment rate or 2 ounces of product added to each quart of lubricant used.

Very old engines (smoking, hard-starting, engine noises, etc.) sometimes can be made to run better by using this very high dose This latter application may take some time to "work in", as much as 3,000 miles of driving before the effects are noticeable. It is thought that the bonding action of the bismuth-tin alloy combined with the mild cleaning ability of the remainder of the dissociated organic chemical help to free piston rings and provide a tighter seal between the ring and the cylinder wall.

Above the 6% treatment rate no additional benefits have been observed as rates above this level appear to be more than what is needed by the machinery for the maximum benefits available from the product.

When the additive is used in pure form for applications such as metal drilling or cutting, the limiting factor is the cost of the additive. It is economically usually most advantageous to mix it with the lubricant appropriate for the purpose, e.g., motor oil, gear oil, cutting oil, hydraulic or transmission fluid, etc.

A few drops of the composition can also be used on a drill bit used in metal boring, or on tap and die tools, etc. This reduces binding, helps make a smoother cut in the metal, and keeps the tools sharp for longer periods.

There may be industrial applications that require a level of friction and wear reduction no matter what the quantity or cost may be. These applications would benefit by using the composition in pure form. The composition is a lubricant in itself, however, it is usually necessary to incorporate other additives such as detergents, dispersants, antioxidants, etc., to make a full functioning lubricant package.

8. The machinery should be operated normally.

When the composition is exposed to high pressure during operation, like that in an internal combustion engine (about 5000 pounds per square inch), the temperature increases, and free bismuth and tin atoms and/or molecules are released from the respective organic carriers to form a bismuth/tin alloy that acts like a metal soap to protectively coat the moving metal parts.

More particularly, the increased mechanical pressure causes the lubricant to be forced out of the space in-between two metal surfaces so that metal to metal contact occurs. This metal to metal contact causes the shearing and galling of the metal surfaces which produces heat. It is this heat (increase in temperature), not the high pressure per se, that causes the dissociation of the bismuth and tin from the organics and the resultant formation of the alloy.

The relationship between temperature and formation of the alloy is direct. Pressure increases directly increase the temperature but the prime relationship is between the temperature and the dissociation.

As the heat rises, more bismuth and tin is released which reduces the friction and heat so that eventually, if pressure remains constant, an equilibrium is reached between the heat generated and the amount of bismuth and tin being released. More alloy reduces the friction which reduces the rise in temperature. As the alloy wears off, friction increases again with the resultant rise is temperature, which again releases alloy (bismuth and tin). With new alloy formation the temperature increase is again abated. The equilibrium is reached between the rate of dissociation and alloy formed, the temperature, and friction. If pressure is increased or decreased, the friction and heat generated will increase or decrease in direct relationship, and a new equilibrium point is reached.

If enough pressure is applied to the lubricant itself to achieve the dissociation temperature, the dissociation and release of the bismuth and tin to form the alloy will occur even without the metal to metal contact. It is known that with sufficient pressure in both the lubricant and between the metal surfaces, even under hydrodynamic conditions, wear will occur because the frictional forces are high enough to be transmitted through the lubricant to the metal surfaces.

If the temperature is high enough without the presence of pressure, for example, the gross overheating of an engine, the dissociation will still occur.

The alloy is generally formed in the high pressure areas, however, if boundary lubrication (metal to metal contact) occurs in a low pressure area, the allow will form in those areas as well. It is the heat generated by the friction caused by the metal to metal contact that causes the dissociation and release of the bismuth and tin to form the protective alloy. In a high pressure area this friction and heat is far more likely to occur than in a low pressure area, hence the composition is much more advantageous to have in the high pressure area where the wear would be of greatest concern.

Wear in these high pressure areas still occurs and fragments of the alloy will be eroded off and be carried by the oil to low pressure areas. Here they may embed themselves in the interstices of the metal surface and provide some protection.

Recombination of the free bismuth and/or tin with the parent molecule (the remainder of the organic) is not likely as the heat generated is also breaking down the lubricant oil and there is free hydrogen and oxygen available to take the place of the released bismuth and tin. The hydrogen and oxygen are more reactive and will combine before the bismuth and tin.

The tenacity of the coatings will also afford protection for the machinery metal surfaces against very high degrees of lubricant contamination by dirt, water, salt water, antifreeze, fuel, acids, and abrasive wear particles. Further, should a loss of lubricant occur, the protection afforded the machinery metal surfaces by virtue of the protective coating formed, is much greater than without the presence of the concentrate coating.

The smoother surface created by the alloy coating, when applied to engines, significantly increases the seal between the piston ring and cylinder wall, which can result in the reduction of oil burning.

An increased seal of the piston ring/cylinder wall interface results which, besides reducing oil consumption, also increases cylinder pressures by reducing blow-by gases and retaining the energy of the combustion process above the piston to where it can be utilized in a more effective manner.

An increase in fuel mileage is also possible and is due in part to the improved seal of the piston ring/cylinder wall interface, and in part to the reduction in friction provided by the invention.

The alloy coating formed by the bismuth-tin combination renders the machinery metal surfaces smoother and provides for increased efficiency of the parent lubricant to maintain hydrodynamic lubrication and effect cooling.

It is believed that, by having the composition constantly present in the lubricant, continuous protection for the machinery is provided. This can be especially helpful and welcome should any unexpected adverse or extreme condition occur. The continuous presence of the invention insures the optimum amount of protection for the machinery in which the product is used.

Preferably the composition is mixed with a lubricant that is being applied to protect the machinery. Any lubricant can benefit from the addition of the product, provided the lubricant is used for its intended purpose and the product is found to be compatible with the lubricant.

Alternatively, the composition can be added in pure form directly to the machinery, letting it mix with lubricant that is already present in the machinery.

Although not wishing to be bound by any theoretical explanation of the invention, it is believed that the mechanism by which the composition works is as follows:

Once the heat and pressure of the metal equipment have reached the proper levels, the organic chemicals dissociate, releasing free bismuth and tin atoms and/or molecules. These metallic element atoms and/or molecules then form a protective alloy coating which bonds to the metal surfaces. The exact nature of the bond is uncertain but is thought to be physical.

Regarding the reduction in oil burning it is believed that when the molecular structure breaks down releasing bismuth-tin, the remainder of the molecule becomes a mild cleaner. It takes 2,000 to 3,000 miles for the cleaning effect to be observed and it is believed that what happens is the sludge is removed from between the rings and the groove on the piston. This allows the ring to flex and provide a better seal. The coating provided by the bismuth-tin alloy increases this seal further.

Without further elaboration, it is believed that one skilled in the art, using the preceding description, can utilize the present invention to its fullest extent. The following examples are, therefore, to be construed as merely illustrative, and not limitative in any way whatsoever, of the remainder of the disclosure.

The following Examples I and II, represent tests comparing the anti-wear characteristics of Valvoline TM 15W40, as the base oil, Mobil 1 5W30 motor oil, the following commercially available oil additives, Tufoil TM, Duralube TM, Slick 50 TM, and the composition of the present invention.

These two Examples represent the results of these tests that compare the effectiveness of each additive. The test systems, test procedures, and test results are also described in these Examples.

EXAMPLE I

The Timken Bearing Test is well-known and is described briefly below: A bearing of hardened steel, being of similar material as a wheel or axle bearing found in a car or truck, is placed in a clamp. This clamp is then placed upon a machine creating part of a lever system. A hanger is placed at the end of the of the lever system upon which weights are placed. As weights are added the pressure is increased between the bearing and a bearing race. The lever system is designed to provide a 30:1 increase from the amount of weight on the hanger to the contact point on the bearing race.

The bearing race is also made of the same material as may be found in the wheel or axle bearing races of a car or truck. The bearing race is spun by a pulley and V-belt system driven by an electric motor. The tension on the V-belt is adjusted such that the pulley mounted upon the motor's shaft will spin within the confines of the V-belt once the pressure has reached a sufficient level to stop the bearing race from turning.

When the bearing race ceases to turn it also stops the pulley connected to the bearing race shaft and the V-belt. The test remains accurate as long as the tension on the belt is not changed from an established level for any particular series of tests for comparison of different lubricants.

To test a lubricant the machine is turned on and the lubricant to be tested is poured into a reservoir cup until a sufficient level is reached such that the lubricant is picked up by the race and carried around its entire circumference. The system formed by the pressure point between the bearing and the bearing race is considered to be lubricated with this level of lubricant. The bearing and the clamp assembly is then placed upon the machine and weights are added to the hanger until the race ceases to spin. Each weight weighs approximately 1.25 pounds which translates to 37.5 pounds at the contact point of the bearing and the bearing race. At the point the race ceases to spin, metal to metal contact, welding and sufficient pressure have occurred which cause the cessation of spin.

The following procedure was used to test the cited lubricants upon the Timken Bearing Test machine.

1. The machine was thoroughly cleaned and a new race installed. A new bearing was installed in the clamp.
2. The reservoir was placed on the machine, the machine was turned on and sufficient lubricant was added to reach the described level of lubrication. The lubricant used to establish a base line for comparison purposes was Valvoline 15w40, Turbo formula, part number 523.
3. The bearing and clamp assembly were placed upon the machine.
4. Weights were added until the race ceased to spin.
5. The machine was turned off and the clamp assembly and oil reservoir were removed.
6. The size and condition of the contact spot were noted.
7. The belt was adjusted to bring the machine to the desired specifications for this series of tests. In this series the desired level of failure for the base lubricant was at 4 weights or approximately 5 pounds of weight. This translates to 150 pounds at the point of contact.
8. The race was wiped clean and then resurfaced by sanding with medium grit emery cloth followed by fine grit emery cloth.
9. The bearing was rotated slightly in the clamp to provide a new surface.
10. The reservoir was then placed back on the machine and the machine was turned on. If necessary, the test sample was replenished to bring the lubricant up to the necessary level.
11. Steps 3 through 10 were repeated. The repetition continued and the belt was adjusted until 3 consecutive tests were run with the base oil and failure occurred at the 4 weight level each time with no further adjustment to the V-belt.
12. The clamp, bearing race, bearing, and reservoir were then flushed with Shell Solvent #140 to remove all lubricant residue and wiped clean. The bearing race was then resurfaced as in step 8 and flushed again with Shell Solvent #140. The bearing race was then wiped dry.
13. Test samples were then prepared for the Tufoil TM, Duralube TM, Slick 50 TM and lubricant additives, all of which were mixed with the Valvoline #523 base oil. Mobil 1 5W30 was also tested by itself.
14. The reservoir was placed on the machine, the machine was turned on, and each test sample was added to give the described level of lubrication.
15. Steps 3,4,5,6,8,9, and 10 were repeated. The number of weights to failure was noted. Each sample was given 3 tests and the mean from each of these test TABLE 1-continued

| LOAD RESISTANCE TEST PROFILE | | |
|---|---|---|
| 140 | 1 | 254 |
| 150 | 28 | 281 |
| 160 | 44 | 297 |
| 170 | 55 | 308 |
| 180 | 66 | 319 |
| 190 | 76 | 329 |
| 200 | 86 | 339 |
| 210 | 96 | 349 |
| 220 | 106 | 359 |
| 230 | 120 | 373 |
| 240 | 135 | 388 |

Figure 6:
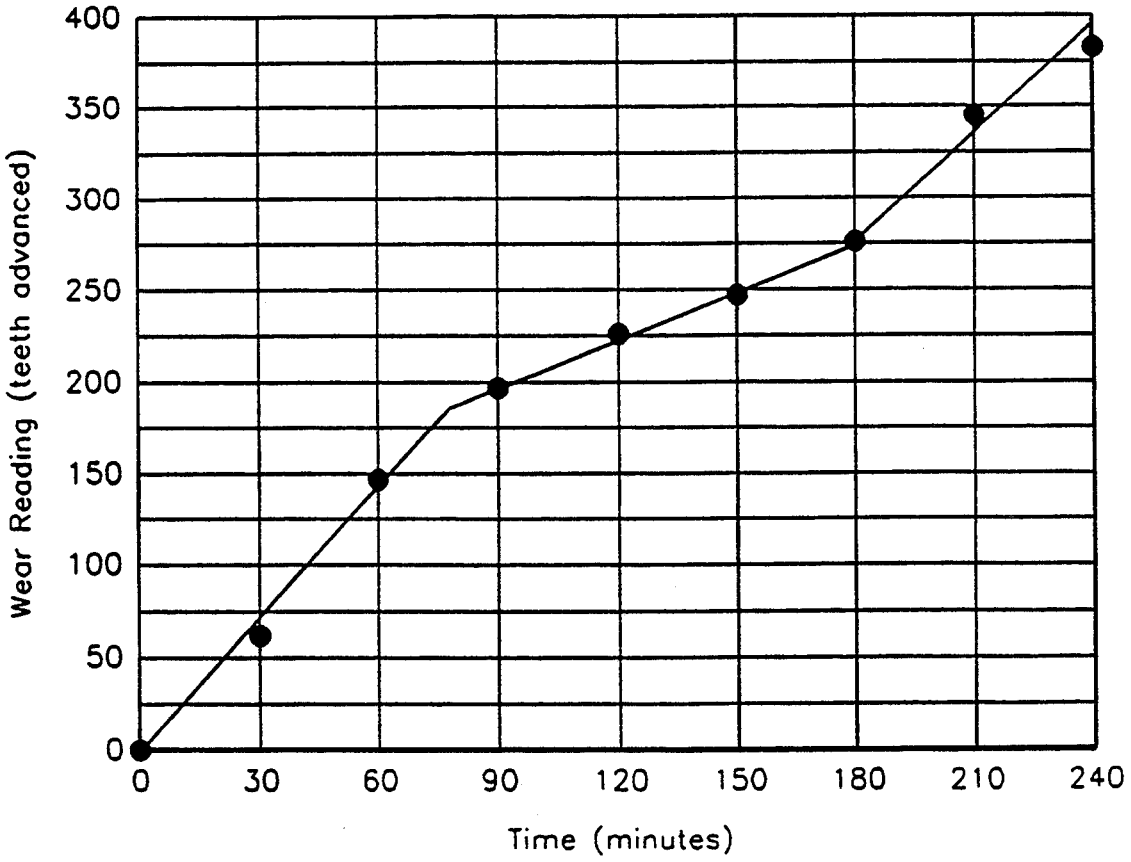
FIG. 6 is a graph illustrating a second load resistance test on the Gamma System using Valvoline TM 15W40 with 5% Duralube TM.

Table 2 below lists the tests results for test (2) which used Valvoline TM 15W40 plus 5% Duralube TM as the test fluid. FIG. 6 is a plot of the results of test (2).

TABLE 2

LOAD RESISTANCE TEST PROFILE

Test No.: 2

| | | | |
|---|---|---|---|
| Test Load: | 100 pounds | Fluid: | Valvoline TM 15W40 w/5% Duralube TM |
| Rotational Speed: | 290 rpm | Temperature: | 150° F. |
| Journal: | Steel | Bearings: | Brass |
| Overall Gamma Slope: | 1.60 (teeth/min) | Adjusted Gamma Slope: | 1.31 (teeth/min) |

| Time (min) | Wheel Reading | No. of Teeth Advanced |
|---|---|---|
| 0 | 123 | 0 |
| 10 | 148 | 25 |
| 20 | 166 | 43 |
| 30 | 186 | 62 |
| 40 | 11 | 87 |
| 50 | 50 | 125 |
| 60 | 72 | 147 |
| 70 | 88 | 164 |
| 80 | 106 | 182 |
| 90 | 121 | 197 |
| 100 | 132 | 208 |
| 110 | 141 | 217 |
| 120 | 150 | 226 |
| 130 | 156 | 232 |
| 140 | 162 | 238 |
| 150 | 171 | 247 |
| 160 | 178 | 254 |
| 170 | 186 | 262 |
| 180 | 0 | 276 |
| 190 | 29 | 305 |
| 200 | 53 | 329 |
| 210 | 69 | 345 |
| 220 | 83 | 359 |
| 230 | 93 | 369 |
| 240 | 107 | 383 |

Figure 7:
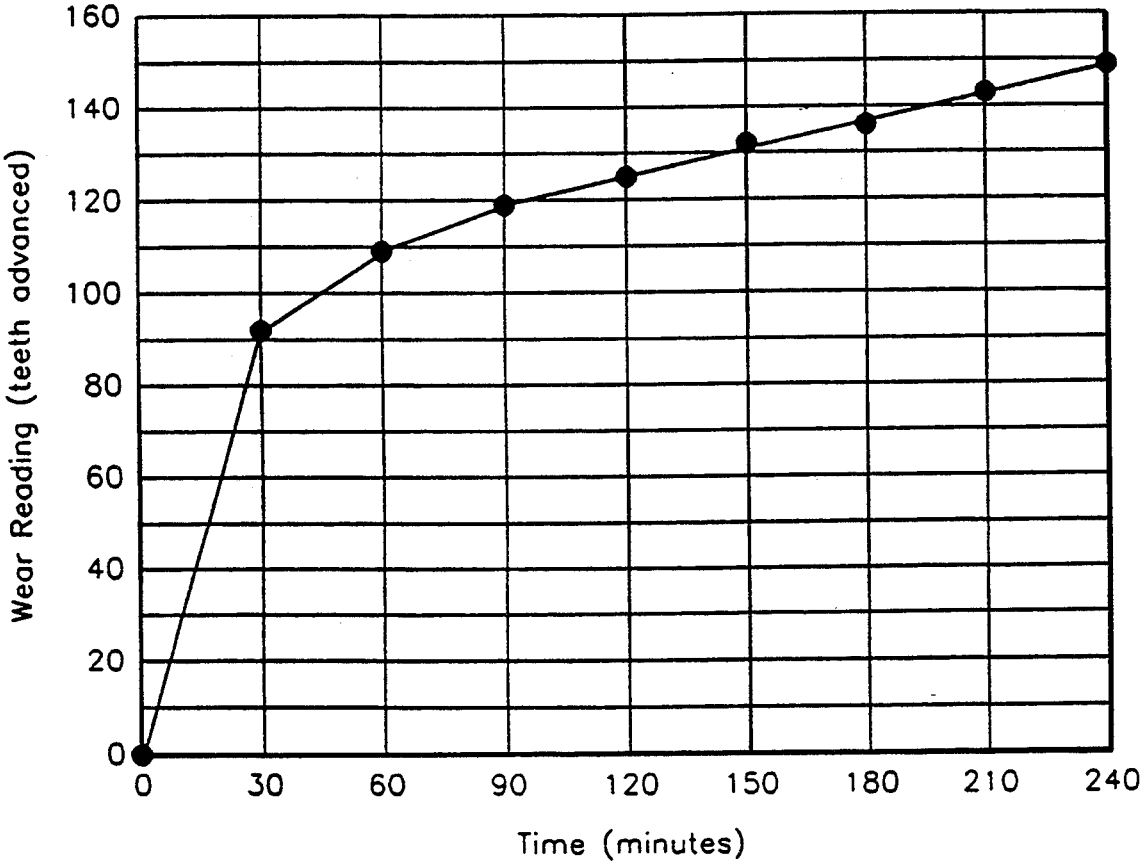
FIG. 7 is a graph illustrating a load resistance test on the Gamma System using Valvoline TM 15W40 and 3% of the present invention.

Table 3 below lists the test results of test (3) which used a test fluid composed of Valvoline TM 15W40 with 3% of the composition of the preferred embodiment of the present invention (bismuth 2-ethylhexanoate/dibutyltin dilaurate). FIG. 7 is a plot of the results of test (3).

TABLE 3

LOAD RESISTANCE TEST PROFILE

Test No.: 3

| | | | |
|---|---|---|---|
| Test Load: | 100 pounds | Fluid: | Valvoline TM 15W40 w/3% present invention |
| Rotational Speed: | 290 rpm | Temperature: | 150° F. |
| Journal: | Steel | Bearings: | Brass |
| Overall Gamma Slope: | 0.62 (0.62 teeth/min) | Adjusted Gamma | 0.22 (teeth/min) |

TABLE 3-continued

LOAD RESISTANCE TEST PROFILE

| | | Slope: |
|---|---|---|
| Time (min) | Wheel Reading | No. of Teeth Advanced |
| 0 | 17 | 0 |
| 10 | 84 | 67 |
| 20 | 97 | 80 |
| 30 | 109 | 92 |
| 40 | 116 | 99 |
| 50 | 122 | 105 |
| 60 | 126 | 109 |
| 70 | 129 | 112 |
| 80 | 132 | 115 |
| 90 | 136 | 119 |
| 100 | 138 | 121 |
| 110 | 140 | 123 |
| 120 | 142 | 125 |
| 130 | 145 | 128 |
| 140 | 147 | 130 |
| 150 | 149 | 132 |
| 160 | 150 | 133 |
| 170 | 152 | 135 |
| 180 | 153 | 136 |
| 190 | 156 | 139 |
| 200 | 158 | 141 |
| 210 | 160 | 143 |
| 220 | 162 | 145 |
| 230 | 164 | 147 |
| 240 | 166 | 149 |

Figure 8:
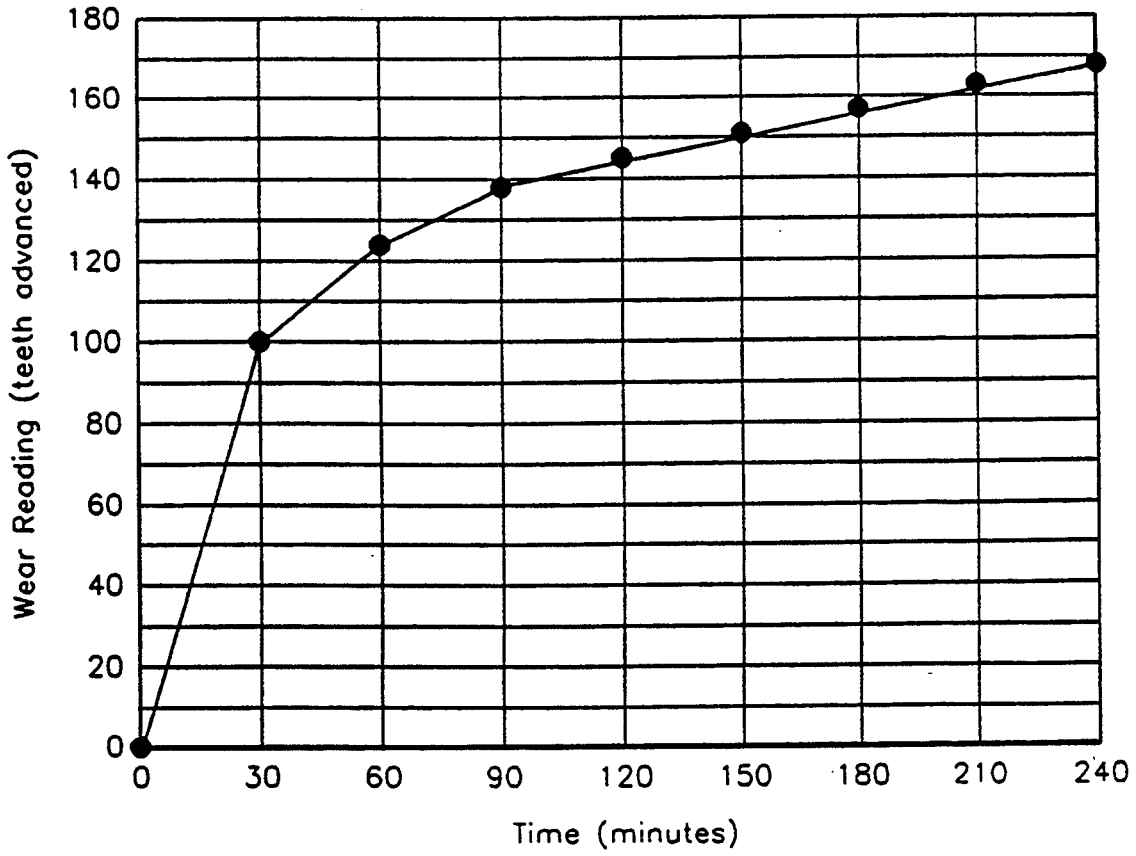
FIG. 8 is a graph illustrating a load resistance test on the Gamma System using Valvoline TM 15W40 and 5% of the present invention.

Table 4 below gives the test results for test (4) with Valvoline TM 15W40 and 5% of the same preferred embodiment composition according to the present invention as the test fluid. The results of test (4) are plotted in FIG. 8.

TABLE 4

LOAD RESISTANCE TEST PROFILE

Test No.: 4

| | | | |
|---|---|---|---|
| Test Load: | 100 pounds | Fluid: | Valvoline TM 15W40 w/5% present invention |
| Rotational Speed: | 290 rpm | Bearings: | Brass |
| Overall Gamma Slope: | 0.70 (teeth/min) | Adjusted Gamma Slope: | 0.20 (teeth/min) |

| Time (min) | Wheel Reading | No. of Teeth Advanced |
|---|---|---|
| 0 | 183 | 0 |
| 10 | 52 | 69 |
| 20 | 71 | 88 |
| 30 | 83 | 100 |
| 40 | 92 | 109 |
| 50 | 102 | 119 |
| 60 | 109 | 126 |
| 70 | 113 | 130 |
| 80 | 117 | 134 |
| 90 | 121 | 138 |
| 100 | 123 | 140 |
| 110 | 126 | 143 |
| 120 | 128 | 145 |
| 130 | 130 | 147 |
| 140 | 132 | 149 |
| 150 | 134 | 151 |
| 160 | 136 | 153 |
| 170 | 138 | 155 |
| 180 | 140 | 157 |
| 190 | 142 | 159 |
| 200 | 144 | 161 |
| 210 | 146 | 163 |
| 220 | 148 | 165 |
| 230 | 150 | 167 |
| 240 | 151 | 168 |

Figure 9:
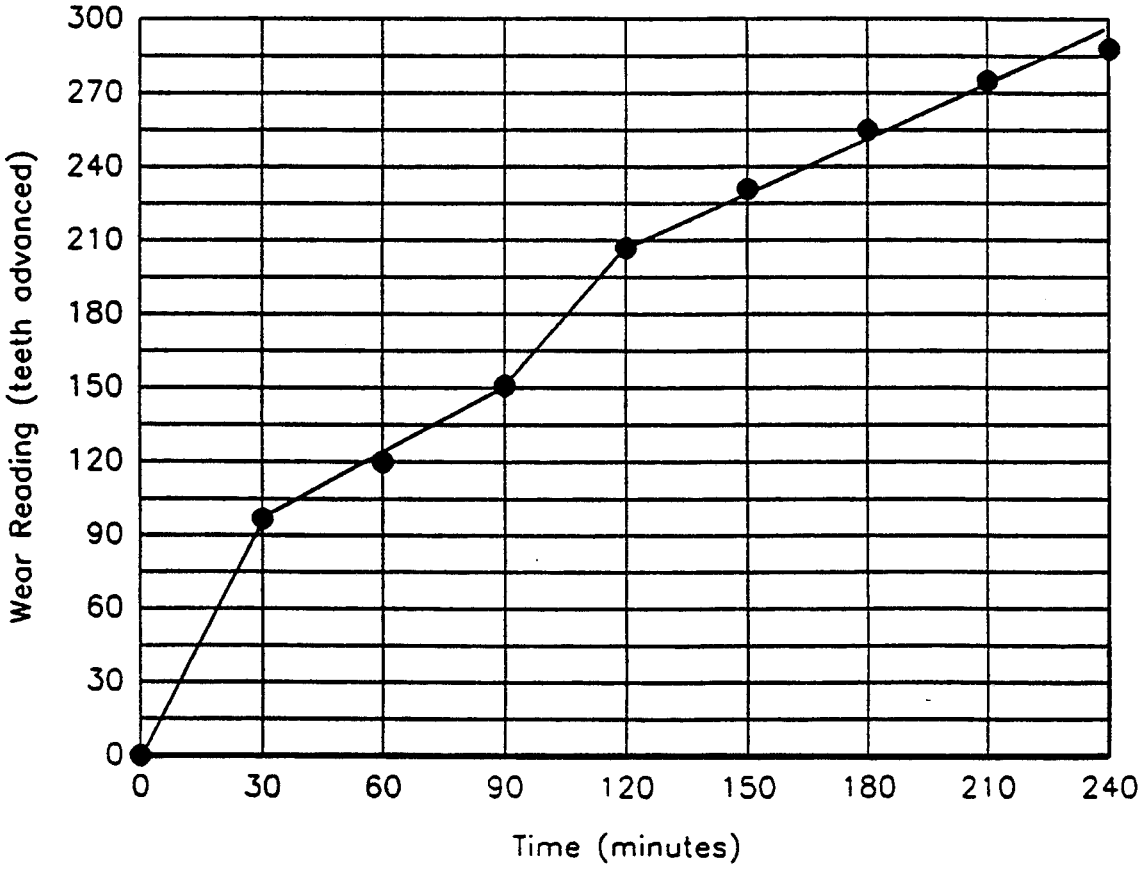
FIG. 9 is a graph illustrating a load resistance test on the Gamma System using Valvoline TM 15W40 and 20% Slick 50 TM.

Test (5) used Valvoline TM 15W40 and 20% Slick 50 TM as the test fluid. The results of test (5) are shown in Table 5 below and plotted in FIG. 9.

TABLE 5

LOAD RESISTANCE TEST PROFILE

Test No.: 5

| | | | |
|---|---|---|---|
| Test Load: | 100 pounds | Fluid: | Valvoline TM 15W40 w/20% Slick 50 TM |
| Rotational Speed: | 290 rpm | Temperature: | 150° F. |
| Journal: | Steel | Bearings: | Brass |
| Overall Gamma Slope: | 1.20 (teeth/min) | Adjusted Gamma Slope: | 0.93 (teeth/min) |

| Time (min) | Wheel Reading | No. of Teeth Advanced |
|---|---|---|
| 0 | 49 | 0 |
| 10 | 115 | 66 |
| 20 | 135 | 86 |
| 30 | 146 | 97 |
| 40 | 152 | 103 |
| 50 | 160 | 111 |
| 60 | 169 | 120 |
| 70 | 178 | 129 |
| 80 | 188 | 139 |
| 90 | 0 | 151 |
| 100 | 22 | 173 |
| 110 | 51 | 202 |
| 120 | 56 | 207 |
| 130 | 65 | 216 |
| 140 | 73 | 224 |
| 150 | 80 | 231 |
| 160 | 89 | 240 |
| 170 | 96 | 247 |
| 180 | 104 | 255 |
| 190 | 112 | 263 |
| 200 | 118 | 269 |
| 210 | 124 | 275 |
| 220 | 128 | 279 |
| 230 | 133 | 284 |
| 240 | 137 | 288 |

For tests (2) through (5), the amount of additive added to the base oil is on a volume basis.

Figure 10:
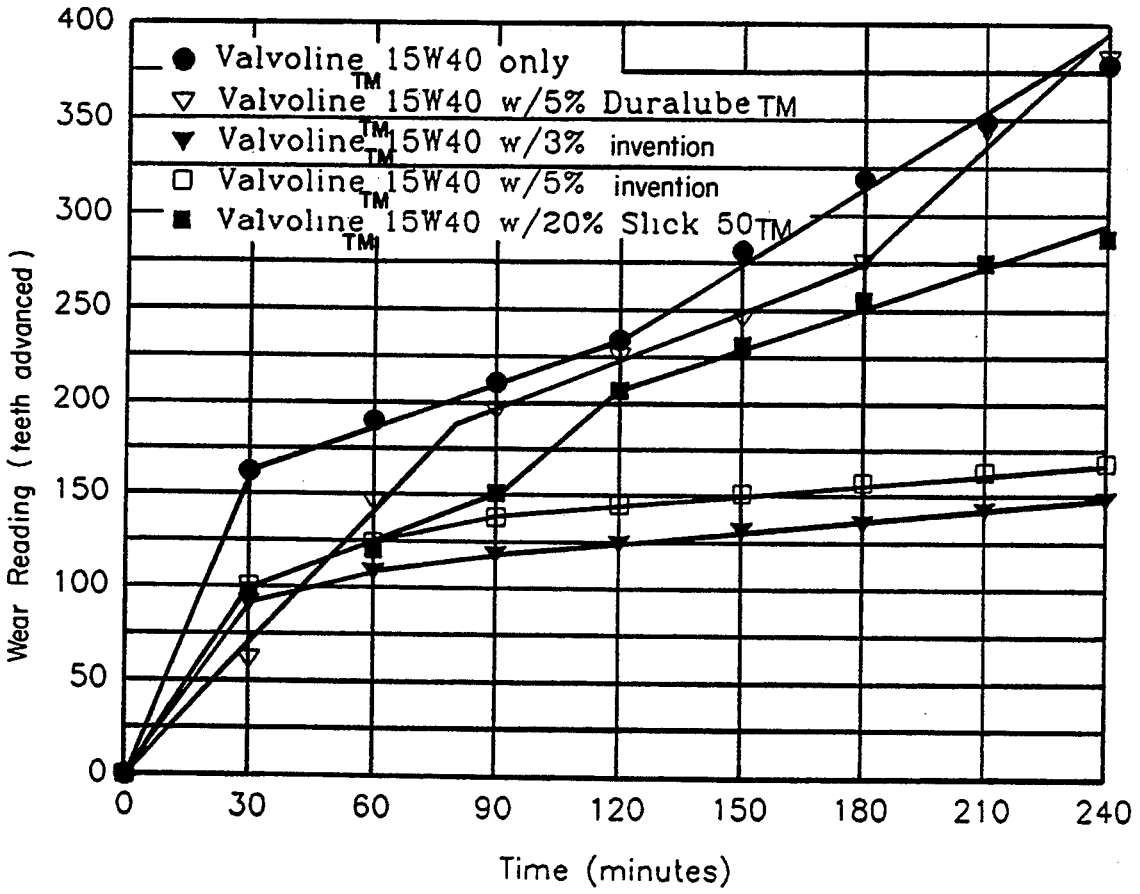
FIG. 10 is a graph illustrating a comparison of the results of the tests shown in FIGS. 5–9.

FIG. 10 compares the results of tests (1) through (5). All of the curves show relatively steep slopes during the first part of the test. This steep sloped can be interpreted as a break-in period of the journal/bearing assembly 18.

The results of the load resistance tests are summarized in terms of Gamma slope in the following Table 6.

TABLE 6

| Test Number | Test Fluid | OGS | AGS |
|---|---|---|---|
| 1 | Base only | 1.62 | 1.10 |
| 2 | Base w/5% Duralube TM | 1.60 | 1.31 |
| 3 | Base w/3% Invention | 0.62 | 0.22 |
| 4 | Base w/5% Invention | 0.70 | 0.20 |
| 5 | Base w/20% Slick 50 TM | 1.20 | 0.93 |

Two additional measures of the performance of an additive are the Wear Rate Reduction (WRR) index and the Service Life Improvement (SLI) index. The WWR indicates the percentage of wear rate reduced using base oil plus additive and is given by the following equation:

$$WRR(\%) = \left[1 - \frac{OGS \text{ of fluid w/additive}}{OGS \text{ of fluid w/o additive}}\right] \times 100 \quad (1)$$

The SLI indicates the factor of tribiological element service life that can be improved using metal conditioner. SLI is derived based on the assumption that the service life of a tribiological element is inversely proportional to the wear rate. Thus, a wear rate of 1 tooth/min has two times the service life of a wear rate of 2 teeth/min.

The SLI is given by the following equation:

$$SLI = \frac{OGS \text{ (without additive)}}{OGS \text{ (with additive)}} \quad (2)$$

The WWR and SLI indexes for tests 2–5 are given in the following Table 7.

| Test ID | Fluid ID | WRR (%) | SLI |
|---|---|---|---|
| 2002 | Base w/5% Duralube TM | 1.23 | 1.01 |
| 2003 | Base w/3% Invention | 61.7 | 2.61 |
| 2004 | Base w/5% Invention | 56.8 | 2.31 |
| 2005 | Base w/30% Slick 50 TM | 25.9 | 1.35 |

To further illustrate what the SLI index means, suppose that a tribiological element has a service life of 1,000 hours without any additives. An SLI of 2.5 would mean that the tribiological element has a service life of 2,500 hours when using the same ratio of additive to base oil.

Based on the WRR and SLI index results presented in Table 7, the additives tested under the conditions stated herein may be ranked from best performance to worst in the following order.

1. Valvoline TM 15W40 w/3% present invention
2. Valvoline TM 15W40 w/5% present invention
3. Valvoline TM 15W40 w/20% Slick TM 50
4. Valvoline TM 15W40 w/5% Duralube TM It may also be concluded from FIG. 10 that Valvoline TM 15W40 with 3% of the present invention's composition performed substantially better than the fluid combinations using Slick 50 TM or Duralube TM additives under the conditions given.

While the OGS of the 5% additive of the present invention was larger than the 3% OGS, the AGS slope of the 5% was smaller than the 3% (0.20 vs. 0.22). It is also observed that the initial readings of the first 30 minutes were significantly higher for the 5% mixture than the 3% mixture.

It is believed that the difference can be attributed to an initially rougher surface on the bearings in the Gamma System which may have required a larger portion of the bearing to break in or seat for the test.

The reduced AGS for the 5% mixture of the present invention, related to the 3% mixture of the present invention, shows that an additional concentration of the present invention is not corrosive over the long term and can be beneficial in further reducing wear especially where extreme conditions may be encountered. The safety of the higher concentrations coupled with the level of wear reduction is an advantage not enjoyed by any other known additive.

EXAMPLE III

The inventor's vehicle, a 1984 Mercury Grand Marquis Colony Park station wagon, with a 302 c.i.d. (5 liter) TBI eight cylinder engine, which was owned since new and had 84,000 miles on the odometer, averaged 14 miles per gallon in rural driving, a mixture of long and short trips. Upon the addition of the compositions of the present invention, mileage increased within one tankful to approximately 19 miles per gallon with the same driving conditions. Prior oil usage of one quart per 3,000 miles ceased completely and the crankcase remained full between oil changes.

EXAMPLE IV

A second vehicle, also the inventor's, a 1980 Chevrolet Citation 2 door with a 151 c.i.d. (2.5 liter), 4 cylinder, conventionally carbureted engine, averaged 24.5 miles per gallon. Upon the addition of the invention an increase to approximately 29–30 miles per gallon was observed. Additionally, sludge observed in the valve train through the oil fill hole in the valve cover was seen to gradually be removed with the continued use of the invention. Once the sludge had been reduced the oil at the end of the oil change was observed to be cleaner than previous oil changes. The vehicle now has 140,000 miles and is running smoothly.

The preceding examples can be repeated with similar success by substituting the generically or specifically described reactants and/or operating conditions of this invention for those used in the preceding examples.

As can be seen from the above, the machinery metals do not react chemically with the bismuth/tin alloy or any of the rest of the additive. The relationship is merely physical with the alloy tenaciously covering the metal parts of the engine. In this way the surface of the metal is not "eaten up" or otherwise changed.

The alloy formed of bismuth-tin forms a protective layer which becomes soft and plastic thereby protecting the machinery metal surfaces underneath.

The alloy is non-reactive with the machinery metal surfaces thereby truly protecting the machinery by forming the protective coating on top of the machinery metal surfaces.

The alloy, being non-reactive, does not form a layer, like the prior art contaminant additives, that is subsurface of the original machinery metal surfaces.

The compounds selected, containing only the metal atom along with associated carbon, hydrogen, and oxygen, upon entering the combustion chamber, do not cause harmful or deleterious effects to the engine or subsequent exhaust system components or pose hazards to the environment.

By-products of the compounds selected, formed from the original compounds entering the combustion chamber, do not cause harmful or deleterious effects to the engine, combustion chamber, subsequent exhaust system components or pose hazards to the environment when exhausted to the atmosphere.

Protection of the machinery metal surfaces by the alloy is afforded even upon loss of lubricant or extreme lubricant contamination by ethylene glycol (antifreeze), water, dirt, salt, fuel dilution, and other contaminants.

If PTFE is desired to be included, the compounds selected are compatible with the PTFE coatings that may ensue with the alloy and are beneficial to the overall operation of the machinery or equipment into which the additive is introduced.

Further, the wear of metal parts in the engine is reduced, so the damaging presence of metal particles in the engine oil is reduced.

Moreover, the components are relatively safe, environmentally friendly and non-toxic. During use, no toxic gases or corrosive by-products are formed.

Also, conventional oil additive compounds such as acid chlorides, lead napthenate, and ZDDP, can be corrosive if too much is added. With the present invention, a severe overdosing (a ten percent mix of oil with the composition) produces no increase in wear metals or any adverse effects such as sludging or clogging of oil passages. The product itself is not toxic but is physically harmful, but not believed fatal, if swallowed. Some of the other above-mentioned compounds are fatal.

Finally, besides providing wear protection, the composition is believed to reduce oil and fuel consumption. It helps to clean a dirty engine and keeps clean engines clean (a clean engine runs more efficiently).

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

What is claimed is:

1. An anti-friction composition, comprising:

a first liquid component including a lubricant;

a second liquid component including bismuth chemically associated with an organic carrier; and a third liquid component including tin chemically associated with an organic carrier, wherein said second and third components together represent a concentration relative to the first component of 1–10%.

2. The composition as recited in claim 1, wherein the second component is selected from the group consisting of bismuth 2-ethylhexanoate and bismuth neodecanoate.

3. The composition as recited in claim 1, wherein the third component is selected from the group consisting of dibutyltin dilaurate, dibutyltin dineodecanoate and dibutyltin diacetate.

4. The composition as recited in claim 2, further comprising naphtha as a solution for the bismuth octoate.

5. The composition as recited in claim 1, further comprising polytetrafluoroethylene.

6. The composition as recited in claim 1, wherein the first component is oil.

7. A method for producing an anti-friction composition, comprising the steps of:

mixing a liquid bismuth/organic carrier compound, and a liquid tin/organic carrier compound to form a liquid solution; and adding the solution to a lubricant.

8. The method as recited in claim 7, further comprising the step of:

introducing the composition to moving metal parts.

9. The method as recited in claim 7, further comprising the step of:

adding polytetrafluoroethylene to the composition.

10. A method for minimizing friction between moving metal parts, comprising the following steps:

mixing a liquid bismuth/organic carrier with a liquid tin/organic carrier to form an anti-friction composition;

mixing the composition with a liquid lubricant;

introducing the composition/lubricant mixture to moving metal parts; and operating the moving metal parts under high pressure, wherein the bismuth and tin dissociate from the organic carriers in a temperature range of 300° F. to 500° F. and form an alloy which coats the moving metal parts.

11. The method as recited in claim 10, further comprising the step of:

adding polytetrafluoroethylene to the composition.

12. An anti-friction composition, comprising:

a first liquid component including bismuth chemically associated with an organic carrier; and a second liquid component including tin chemically associated with an organic carrier.

13. The composition as recited in claim 12, wherein the first component is selected from the group consisting of bismuth 2-ethylhexanoate and bismuth neodecanoate.

14. The composition as recited in claim 12, wherein the second component is selected from the group consisting of dibutyltin dilaurate, dibutyltin dineodecanoate and dibutyltin diacetate.

15. The composition as recited in claim 12, further comprising polytetrafluoroethylene.

16. A method for producing an anti-friction composition, comprising the steps of:

mixing a liquid bismuth/organic carrier compound, with a liquid tin/organic carrier compound.

17. The method as recited in claim 16, further comprising the step of:

introducing the composition to moving metal parts.

18. The method as recited in claim 16, further comprising the step of:

adding polytetrafluoroethylene to the composition.

19. A method for minimizing friction between moving metal parts, comprising the following steps:

forming an antifriction composition by mixing a liquid bismuth/organic tarrier with a liquid tin/organic carrier;

introducing the composition to moving metal parts; and operating the moving metal parts under high pressure, wherein the bismuth and tin dissociate from the organic carriers in a temperature range of 300° F. to 500° F. and form an alloy which coats the moving metal parts.

20. The method as recited in claim 19, further comprising the step of:

adding polytetrafluoroethylene to the composition.

21. An anti-friction composition, comprising:

a first liquid component including a lubricant;

a second liquid component including bismuth chemically associated with an organic carrier; and a third liquid component including tin chemically associated with an organic carrier, wherein said bismuth is about 11 parts per weight relative to about 1 part per weight of said tin, and said second and third components together represent a concentration relative to the first component of 1–10%.

22. The composition as recited in claim 21, wherein the second component is selected from the group consisting of bismuth 2-ethylhexanoate and bismuth neodecanoate.

23. The composition as recited in claim 22, wherein the third component is selected from the group consisting of dibutyltin dilaurate, dibutyltin dineodecanoate and dibutyltin diacetate.

24. The composition as recited in claim 21, further comprising polytetrafluoroethylene.

25. The composition as recited in claim 21, wherein the first component is oil.

26. A method for producing an anti-friction composition, comprising the steps of:

mixing a liquid bismuth/organic carrier compound, and a liquid tin/organic carrier compound to form a liquid solution, wherein the bismuth is about 11 parts per weight relative to about 1 part per weight of the tin; and adding the solution to a liquid lubricant at a concentration of about 1–10% of the solution relative to the liquid lubricant.

27. The method as recited in claim 26, further comprising the step of:

introducing the composition to moving metal parts.

28. The method as recited in claim 26, further comprising the step of:

adding polytetrafluoroethylene to the composition.

29. A method for minimizing friction between moving metal parts, comprising the following steps:

mixing a liquid bismuth/organic carrier with a liquid tin/organic carrier to form an anti-friction composition, wherein the bismuth is about 11 parts per weight relative to about 1 part per weight of the tin;

mixing the composition with a liquid lubricant at a concentration of about 1–10% of the solution relative to the liquid lubricant;

introducing the composition/lubricant mixture to moving metal parts; and operating the moving metal parts under high pressure, wherein the bismuth and tin dissociate from the organic carriers in a temperature range of 300° F. to 500° F. and form an alloy which coats the moving metal parts.

30. The method as recited in claim 29, further comprising the step of:

adding polytetrafluoroethylene to the composition.

31. An anti-friction composition, comprising:

a first liquid component including a lubricant;

a second liquid component including bismuth chemically associated with an organic carrier; and a third liquid component including tin chemically associated with an organic carrier, wherein said second liquid component is about 7 parts per volume relative to about 1 part per volume of said third component, and said second and third components together represent a concentration relative to the first component of 1–10%.

32. The composition as recited in claim 31, wherein the second component is selected from the group consisting of bismuth 2-ethylhexanoate and bismuth neodecanoate.

33. The composition as recited in claim 31, wherein the third component is selected from the group consisting of dibutyltin dilaurate, dibutyltin dineodecanoate and dibutyltin diacetate.

34. The composition as recited in claim 31, further comprising polytetrafluoroethylene.

35. The composition as recited in claim 31, wherein the first component is oil.

36. A method for producing an anti-friction composition, comprising the steps of:

mixing a liquid bismuth/organic carrier compound, and a liquid tin/organic carrier compound to form a liquid solution, wherein the liquid bismuth/organic carrier compound is about 7 parts per volume relative to about 1 part per volume of the tin/organic carrier compound; and adding the solution to a liquid lubricant at a concentration of about 1–10% of the solution relative to the liquid lubricant.

37. The method as recited in claim 36, further comprising the step of:

introducing the composition to moving metal parts.

38. The method as recited in claim 37, further comprising the step of:

adding polytetrafluoroethylene to the composition.

39. A method for minimizing friction between moving metal parts, comprising the following steps:

mixing a liquid bismuth/organic carrier with a liquid tin/organic carrier to form an anti-friction composition, wherein the bismuth/organic carrier compound is about 7 parts per volume relative to about 1 part per volume of the tin/organic carrier compound;

mixing the composition with a liquid lubricant at a concentration of about 1–10% of the solution relative to the liquid lubricant;

introducing the composition/lubricant mixture to moving metal parts; and operating the moving metal parts under high pressure, wherein the bismuth and tin dissociate from the organic carriers in a temperature range of 300° F. to 500° F. and form an alloy which coats the moving metal parts.

40. The method as recited in claim 39, further comprising the step of:

adding polytetrafluoroethylene to the composition.

41. The composition as recited in claim 1, wherein the second component is about 28% by weight bismuth octoate in solution.

42. The composition is recited in claim 41, wherein the third component is about 18–19% by weight dibutyltin dilaurate in solution.

43. The composition as recited in claim 12, wherein the second component is about 28% by weight bismuth octoate in solution.

44. The composition is recited in claim 43, wherein the third component is about 18–19% by weight dibutyltin dilaurate in solution.

* * * * *